US011952740B2

(12) United States Patent
Hall et al.

(10) Patent No.: US 11,952,740 B2
(45) Date of Patent: Apr. 9, 2024

(54) BUCKET AND A GROUND MOVING APPARATUS INCLUDING THE BUCKET

(71) Applicant: AUSTIN ENGINEERING LIMITED, Milton, Queensland (AU)

(72) Inventors: Jamie Vincent Clarke Hall, Kalamunda (AU); Lyndon Brian Greeshaw, Yokine (AU)

(73) Assignee: Austin Engineering Limited, Milton (AU)

( * ) Notice: Subject to any disclaimer, the term of this patent is extended or adjusted under 35 U.S.C. 154(b) by 992 days.

(21) Appl. No.: 16/616,413

(22) PCT Filed: May 23, 2018

(86) PCT No.: PCT/AU2018/050499
§ 371 (c)(1),
(2) Date: Nov. 22, 2019

(87) PCT Pub. No.: WO2018/213883
PCT Pub. Date: Nov. 29, 2018

(65) Prior Publication Data

US 2020/0123732 A1 Apr. 23, 2020

(30) Foreign Application Priority Data

May 23, 2017 (WO) ..... PCT/AU2017/050483

(51) Int. Cl.
*E02F 3/40* (2006.01)
*E02F 3/60* (2006.01)
*E02F 9/28* (2006.01)

(52) U.S. Cl.
CPC ..... *E02F 3/40* (2013.01); *E02F 3/60* (2013.01); *E02F 9/2883* (2013.01)

(58) Field of Classification Search
CPC ..... E02F 3/40; E02F 3/60; E02F 9/2883
See application file for complete search history.

(56) References Cited

U.S. PATENT DOCUMENTS 866,971 A * 9/1907 Sherwood ..... E02F 3/60 37/398
1,001,289 A 8/1911 McKee et al.
(Continued)

FOREIGN PATENT DOCUMENTS

CA 2623512 A1 9/2009
CN 110258683 A * 9/2019
(Continued)

OTHER PUBLICATIONS

EPO, "Extended European Search Report", App. No. 18805687.3, dated Dec. 22, 2020, 14 pages.
(Continued)

*Primary Examiner* — Jessica H Lutz
(74) *Attorney, Agent, or Firm* — Dorsey & Whitney LLP

(57) ABSTRACT

A bucket (10) for moving ground material, the bucket (10) comprising a handling section (12) with a mounting arrangement (64) for coupling to a machine, a load section (14) mounted on the handling section (12) such that the load section (14) is separable from the handling section (12) so that the load section (14) can be separated and replaced with another load section (14). The handling section (12) may include a mounting formation (46), and the load section (14) may include a further mounting formation (20) that is complementary to said mounting formation (46) and the mounting formation (46) is configured to receive the further mounting formation (20) therein and the mounting (20) and complementary mounting formations (46) have surfaces that are in abutment.

21 Claims, 16 Drawing Sheets

(56) References Cited

U.S. PATENT DOCUMENTS

| | | | | | |
|---|---|---|---|---|---|
| 1,077,486 | A | | 11/1913 | McKee | |
| 1,107,252 | A | | 8/1914 | Black | |
| 1,444,760 | A | * | 2/1923 | Whitcraft | E02F 3/40 37/444 |
| 1,479,340 | A | * | 1/1924 | Trainor | E02F 3/40 37/444 |
| 1,539,863 | A | * | 6/1925 | Pemberton | E02F 3/40 37/444 |
| 1,582,577 | A | * | 4/1926 | Crane | E02F 3/40 37/444 |
| 1,745,436 | A | * | 2/1930 | Miley | E02F 3/40 37/444 |
| 1,975,625 | A | * | 10/1934 | Lewis | E02F 3/60 37/398 |
| 2,243,965 | A | * | 6/1941 | Larsen | E02F 3/40 37/444 |
| 2,334,460 | A | * | 11/1943 | Weimer | E02F 3/60 37/396 |
| 2,336,749 | A | | 12/1943 | Ratkowski | |
| 2,584,416 | A | | 2/1952 | Boehringer | |
| 2,926,800 | A | * | 3/1960 | Larsen | E02F 3/40 37/444 |
| 3,107,445 | A | * | 10/1963 | Ratkowski | E02F 3/40 37/444 |
| 4,939,855 | A | | 7/1990 | Mccreary | |
| 5,016,365 | A | | 5/1991 | Robinson | |
| 5,063,694 | A | | 11/1991 | Mccreary | |
| 5,261,170 | A | | 11/1993 | Ward | |
| 6,237,260 | B1 | * | 5/2001 | Gooch | E02F 3/60 37/403 |
| 7,285,760 | B2 | * | 10/2007 | Reusche | A01K 7/027 220/816 |
| 7,681,689 | B2 | * | 3/2010 | Imamura | F16F 15/02 37/444 |
| 9,428,881 | B1 | * | 8/2016 | Chabura | E02F 3/40 |
| 9,903,092 | B2 | * | 2/2018 | Lunn | E02F 9/2808 |
| 9,995,015 | B2 | * | 6/2018 | Beckmann | E02F 3/40 |
| 10,024,028 | B2 | * | 7/2018 | Flores | E02F 3/60 |
| 10,329,734 | B2 | * | 6/2019 | Garcia-Huidobro Valdivieso | E02F 3/40 |
| D909,426 | S | * | 2/2021 | Hall | D15/32 |
| D909,427 | S | * | 2/2021 | Hall | D15/32 |
| 2006/0182590 | A1 | | 8/2006 | Mcfarland | |
| 2009/0183398 | A1 | * | 7/2009 | McClallen | E02F 3/40 37/444 |
| 2010/0000129 | A1 | * | 1/2010 | Balemi | E02F 3/40 37/444 |
| 2014/0230293 | A1 | | 8/2014 | Lunn et al. | |
| 2014/0237869 | A1 | | 8/2014 | Caux et al. | |
| 2021/0062455 | A1 | * | 3/2021 | Simanskaite | E02F 3/3609 |
| 2021/0062456 | A1 | * | 3/2021 | Hu | E02F 3/3609 |

FOREIGN PATENT DOCUMENTS

| | | | | | |
|---|---|---|---|---|---|
| FR | 2939160 | B1 | | 6/2019 | |
| JP | S5625526 | A | | 3/1981 | |
| JP | 2002294739 | A | | 10/2002 | |
| KR | 2005107980 | A | * | 11/2005 | E02F 3/3604 |
| KR | 101366614 | B1 | | 2/2014 | |
| RU | 2431020 | C1 | | 10/2011 | |
| WO | 9005813 | A1 | | 5/1990 | |
| WO | WO-2007058545 | A1 | * | 5/2007 | E02F 3/36 |
| WO | 2007098542 | A1 | | 9/2007 | |
| WO | 2011011825 | A1 | | 2/2011 | |
| WO | 2015077735 | A1 | | 5/2015 | |
| WO | WO-2019072652 | A1 | * | 4/2019 | E02F 3/40 |
| WO | WO-2019162249 | A1 | * | 8/2019 | E02F 3/34 |
| WO | WO-2021061102 | A1 | * | 4/2021 | E02F 3/40 |

OTHER PUBLICATIONS

PCT, "International Search Report & Written Opinion", App. No. PCT/AU2017/05048, dated Aug. 3, 2017, 14 pages.

PCT, "International Search Report and Written Opinion", App. No. PCT/AU2018/050499, dated Aug. 21, 2018, 14 pages.

* cited by examiner

BUCKET AND A GROUND MOVING APPARATUS INCLUDING THE BUCKET

FIELD

This disclosure relates to a bucket and a ground moving apparatus including the bucket. The disclosure also extends to a method of repairing a ground moving bucket.

The disclosure relates particularly but not exclusively to an excavation bucket. It will therefore be convenient to hereinafter describe the invention with reference to this example application. For example, the excavation bucket may be used on an excavator for digging trenches and longitudinal channels in the ground and for material handling in mines and quarries. However, it is to be understood that the disclosure is capable of broader application and applies to other buckets and machine for material handling.

BACKGROUND

The reference to prior art in this specification is not and should not be taken as an acknowledgment or any form of suggestion that the referenced prior art forms part of the common general knowledge in Australia or in any other country.

Earth or ground moving machines have wide applications in construction, mining and the like. Such machines include excavators, bulldozers, dredgers, draglines, reclaimers and bucket wheels. The buckets have one part that interacts with a bucket handling arrangement on the machine and a bucket shaped material container. The buckets are detachably mounted to an articulated arm of the machine.

An excavator or excavation apparatus is used to dig or excavate channels and holes in the ground. An excavation can be carried out for a multitude of reasons including laying pipes, servicing and repairing pipes and also for general excavations in the ground.

Excavators are also used in open-cut mining to excavate post-blasted or loose overburden and transfer the material into dump trucks. Mining buckets may be manufactured by a standard original equipment manufacturer (OEM) or custom engineered to suit site specific applications such as material type and density. Excavated materials include hard rock, iron ore and coal.

An excavator typically comprises a support or body and a boom extending from the support and a dipper at a remote end of the boom that articulates relative to the boom. The support typically is a vehicle having ground engaging formations that can move across the ground and can also rotate on the same spot on the ground. The support also includes an operator cab which is used by an operator to operate the excavator. An excavator bucket is detachably mounted on an end of the dipper remote from the support. The bucket is maneuvered by a bucket handling arrangement that typically includes a plurality of hydraulic rams for pivoting the bucket.

An excavator bucket has an upper part of the bucket that interacts with the bucket handling arrangement and a lower section that forms the bucket shaped material container.

The material handling section of earth or ground moving buckets is subjected to high levels of wear and tear in the normal day to day operation and use of the excavator. Some prior buckets have been designed to withstand the harsh operating conditions and extend their working life by as much as possible. For example, some prior art buckets comprise a steel body that is lined internally with replaceable wear liners and wear guards. There is considerable downtime in re-lining a bucket, for example, the manufacturing time would be about six weeks.

Eventually, the material handling section will need to be replaced. This means that a whole new bucket needs to be fabricated. Related to this, there is also considerable expense. The upper part of the bucket that interacts with the bucket handling arrangement requires high tolerance machining and this is time consuming and expensive.

DEFINITION

In the specification and claims, the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

SUMMARY OF DISCLOSURE

Applicant recognizes that it would be beneficial if the downtime used to replace, repair or recondition worn or damaged wear liners and buckets could be kept as low as possible.

According to one aspect of the disclosure there is provided a bucket for moving ground material, the bucket comprising:

- a handling section with a mounting arrangement for coupling to a machine; and
- a load section mounted on the handling section such that the load section is separable from the handling section so that the load section can be separated and replaced with another load section.

The ground material may be any suitable material that is desired to be excavated and moved and includes soil, earth, post blast overburden, loose overburden, coal, metalliferous ore and the like.

The machine to which the bucket is mounted may be any suitable machine used for moving earth or ground material and includes excavators, draglines, bulldozers, dredgers, rope shovel dipper, bucket wheel and loaders.

The load section may be joined to the handling section by welding and be separable or detachable from the handling section by breaking the weld.

Instead, the handling section may be mounted on the handling section by fastening elements and be separable or detachable from the handling section by removing the fastening elements.

The fastening elements may be rivets, bolts or other suitable faster.

The handling section may include a mounting formation, and the load section may include a further complementary mounting formation that engages the mounting formation on the handling section to mount the handling section on the load section.

The first mounting formation may be configured to snugly receive the second mounting formation therein and the mounting and complementary mounting formations may have surfaces that are in abutment.

The mounting arrangement for coupling to a machine may be any suitable mounting arrangement for coupling a ground moving bucket to a machine. Suitably the mounting arrangement comprises at least one ear plate.

According to another aspect of the disclosure, there is provided a bucket for moving ground material, the bucket comprising:

a handling section with a mounting arrangement for coupling to a machine;

a load section mounted on the handling section such that the load section is separable from the handling section so that the load section can be separated and replaced with another load section;

wherein the handling section includes a mounting formation, and the load section includes a further mounting formation that is complementary to said mounting formation and the mounting formation is configured to receive the further mounting formation therein and the mounting and complementary mounting formations have surfaces that are in abutment.

The use of complementary mounting formations that are in abutment avoids the use of additional connecting devices such as connecting plates or other connecting devices. Additional plates or connectors can interfere with material handling and/or may be subject to damage during use.

The mounting formation may have at least one depending skirt that snugly overlaps and abuts a complementary recess at the upper part of the complementary mounting formation. In this way, the abutting surfaces transfer stresses and forces.

The mounting formation or the complementary mounting formation may also have at least one key section and the other of the mounting formation or the complementary mounting formation may have a complementary recess to assist in correctly aligning the two sections.

The load section may comprise a frame and a plurality of plates mounted on the frame.

At least one of the plates may be separable or detachable from the frame so that the plate can be separated and replaced with another plate. Optionally, each of the plates may be separable from the frame so that they can each be replaced when worn or damaged. This may be compared with conventional one piece buckets whereby, for example, if a side wall was damaged in use, the whole bucket would need to be replaced.

The at least one of the plates may be separably or detachably mounted on the frame by welding and may be separated from the frame by breaking the weld.

The frame may have two sides and the load section may include side plates mounted on each side of the frame.

The frame may define at least one support panel extending between the sides, and the load section may include at least one support plate mounted on the frame and extending across the support panel.

The at least one support plate may be separable from the frame so that the support plate can be separated and replaced with another support plate, e.g. when worn or damaged.

The at least one support plate may comprise two plate elements joined to each other, and the two plate elements may have a different thickness or plate strength. This enables the two plate elements to be engineered to withstand different forces and loads. In turn, this enables a plate element positioned in an area of high wear to be engineered to have higher strength and wear resistance properties than the other plate element.

In another form, the frame may define two support panels extending between the sides of the frame and the load section may include support plates extending across each of the two support panels.

The properties of the plates such as thickness and wear resistance of the material can be selected according to site specific requirements. The plates may be thicker, made of high strength and/or a wear resistant material in high wear areas. Wear liners would not normally not be required. The overall weight of the bucket may thus be less than conventional buckets.

The load section may comprise a base and a wall extending up from the base, and the load section may also have an open top.

The wall may have an upper edge forming the further mounting formation that engages the mounting formation on the handling section.

The frame may form a mouth through which material enters and leaves the load section.

The bucket may further include a scraper mounted on the frame adjacent the mouth.

The scraper may be separable from the frame to enable the scraper to be replaced with another scraper. This might occur if a scraper becomes worn or damaged or ground conditions change such that a different scraper is required.

Yet further, the bucket or excavator may be utilized in a different application that requires a different design of bucket.

The bucket may further include a plurality of replaceable ground engaging formations removably mounted on the scraper and on the frame adjacent the mouth.

Further, the bucket may also include a plurality of replaceable corner protection elements removably mounted on the frame at spaced intervals along the sides of the frame.

The handling section may include an upper mounting plate and the mounting formation may comprise a skirt extending away from the upper plate. For example, the mounting plate may be substantially rectangular, and the skirt may depend from three sides of the rectangular mounting plate.

The mounting arrangement on the handling section may include any suitable mount for coupling a bucket to an earth moving machine. Suitably the mounting arrangement includes a plurality of ear plates for interacting with an external bucket handling arrangement, projecting up from the mounting plate and spaced apart from each other. Each ear plate may form an opening for receiving a pivot pin there through whereby to permit the bucket to be pivoted relative to the bucket handling arrangement.

According to another aspect of the disclosure, there is provided a bucket for moving ground material, the bucket comprising:

a handling section; and a load section mounted on the handling section by welding that is separable from the handling section by breaking the weld so that the load section can be replaced with another load section, wherein the load section comprises a frame and a plurality of plates mounted on the frame by welding, and at least one of the plurality of plates is separable from the frame by breaking the weld so that the plate can be replaced with another plate.

Suitably the bucket is an excavation bucket.

The handling section may define a mounting formation, and the load section may define a complementary mounting formation that is snugly received within said mounting formation.

The handling section may include a top plate having a peripheral edge and the mounting formation may comprise a skirt depending from the peripheral edge of the top plate.

According to another aspect of the disclosure, there is provided a handling section for an excavator bucket comprising a substantially rectangular mounting plate with at least one mounting element for coupling to a machine and a skirt depending from three sides of the mounting plate, wherein the skirt comprises a mounting formation for mounting on a load section.

The load section may include a wall having an upper edge forming the further mounting formation.

According to another aspect of the disclosure, there is provided a load section for an excavator bucket, the load section comprising a base, two side walls, a rear wall, each wall having an upper edge defining an open top and forming a mounting formation for mounting on a handling section.

The load section may include two side plates and one support plate, and each of the two side and one support plates may be separable from the frame.

According to another aspect of the disclosure, there is provided a bucket for moving ground material, the bucket including:

a frame; and a plurality of plates mounted on the frame, at least one of the plurality of plates being separable from the frame to enable the plate to be replaced with another plate.

In this way, plates can be removed and replaced when worn or damaged.

The at least one of the plurality of plates may be welded to the frame and be separable from the frame by breaking the weld.

Optionally, each of the plurality of plates may be separable from the frame so that all the plates can be replaced.

The frame may have two sides and the load section may include side plates mounted on the sides, and each of the side plates may be separable from the frame so that they can be replaced with other side plates.

The frame may define at least one support panel between the side panels, and the load section may include at least one support plate mounted on the frame and extending across the support panel, and the at least one support plate may be separable from the frame so that it can be replaced with another plate, e.g. when worn or damaged.

In one form, the frame may define one support panel, e.g. that is curved along its length, and one support plate, e.g. with a corresponding curve, extending across the support panel.

The support plate may comprise two plate elements joined to each other, e.g. by being welded to each other, and the two plate elements may have a different thickness or load strength. This enables the two plate elements to be engaged to withstand different forces and loads.

In another form, the frame may define two support panels and load section may include two separate support plates extending across the two support panels.

The bucket may further include a top plate mounted on the frame and plurality of plates, and a plurality of ear plates on the top plate for interacting with an external bucket handling arrangement, projecting up from the mounting plate and spaced apart from each other.

Each ear plate may form an opening for receiving a pivot pin there through whereby to permit the bucket to be pivoted relative to the bucket handling arrangement.

According to another aspect of the disclosure, there is provided an excavator for excavating ground material from the ground, comprising:

a support;

an articulating member extending from the support; and a bucket mounted on an end of the articulating member remote from the support, the bucket comprising: a load section; and a handling section mounted on the load section that is separable from the handling section so that the load section can be separated and replaced with another load section.

The support may be a movable support having ground engaging formations and the support member may include an operator cab.

The articulating member may comprise a boom extending from the body and a dipper at a remote end of the boom that articulates relative to the boom.

The handling section may be mounted on the load section by welding the load section to the handling section and is separated from the load section by breaking the weld.

Alternatively, the handling section may be mounted on the load section by fastening elements that are passed through the load section and the handling section to secure the load and handling sections to each other.

The handling section may include a mounting formation, and the load section may include a further mounting formation that is complementary to said mounting formation.

The further mounting formation may be configured to be snugly received within said mounting formation and abut said mounting formation.

The bucket of the excavator may include any one or more of the optional features of the bucket defined in the preceding aspect of the disclosure.

According to another aspect of the disclosure, there is provided a machine for moving ground material, comprising:

a support;

an articulating member extending from the support; and a bucket comprising: a load section; and a handling section mounted on the load section by welding that is separable from the handling section by breaking the weld so that the load section can be replaced with another load section; and wherein the load section comprises a frame and a plurality of plates welded on the frame, and each of the plurality of plates is separable from the frame by breaking the weld so that a plate can be replaced with another plate.

The machine may be an excavator.

The excavator and the bucket may include any one or more of the features of the excavator and bucket defined in the preceding aspects of the disclosure.

According to another aspect of the disclosure, there is provided a method of servicing a bucket comprising a load section for engaging ground material, a handling section mounted on the load section that is separable from the handling section, the method including:

separating the load section from the handling section; and attaching another load section to the handling section.

The method may include sensing when the load section needs to be replaced.

The load section and the handling section may be welded to each other and separating the load section from the handling section may comprise breaking the weld mounting them to each other, and attaching another load section to the handling section may comprise welding the load and handling sections to each other.

Separating the load section from the handling section may also comprise removing fastening elements from the load section and handling section that attach the sections to each other.

Attaching another load section to the handling section may comprises passing fastening elements through each of the load and handling sections to attach the sections.

Passing fastening elements through each of the load and handling sections may comprise passing bolts or rivets through each of the load and handling sections.

According to another aspect of the disclosure, there is provided a method of repairing a ground moving bucket comprising a handling section, and a load section that is separably mounted on the handling section by welding, the method including:

sensing when the load carrying section needs replacement;

separating the load carrying section from the handling section by breaking the weld; and attaching another load section to the handling section.

The bucket may be an excavator bucket.

The method may include any one or more of the features of the preceding aspect of the disclosure.

According to another aspect of the disclosure there is provided a method of servicing a bucket comprising a frame, and a plurality of plates mounted on the frame, at least one of the plurality of plates being separable from the frame, the method including:

detecting when one of the separable plates needs replacement;

separating the plate from the frame; and attaching another plate to the frame.

The at least one of the plurality of plates may be welded on the frame and the plate may be separated from the frame by breaking the weld.

Further attaching another plate to the frame may include welding the plate to the frame.

Further each of the plurality of plates may be separable or detachable from the frame so that all the plates can be replaced.

According to another aspect of the disclosure, there is provided a method of repairing a ground moving bucket comprising a frame, and a plurality of plates mounted on the frame, at least one of the plurality of plates being separable from the frame, the method including detecting when one of the separable plates needs replacement; separating the plate from the frame; and attaching another plate to the frame.

DETAILED DESCRIPTION

An excavation bucket and an excavator in accordance with this disclosure may manifest itself in a variety of forms. It will be convenient to hereinafter describe several embodiments of the invention in detail with reference to the accompanying drawings. The purpose of providing this detailed description is to instruct persons having an interest in the subject matter of the invention how to carry the invention into practical effect. However, it is to be clearly understood that the specific nature of this detailed description does not supersede the generality of the preceding broad description. In the drawings:

Figure 1:
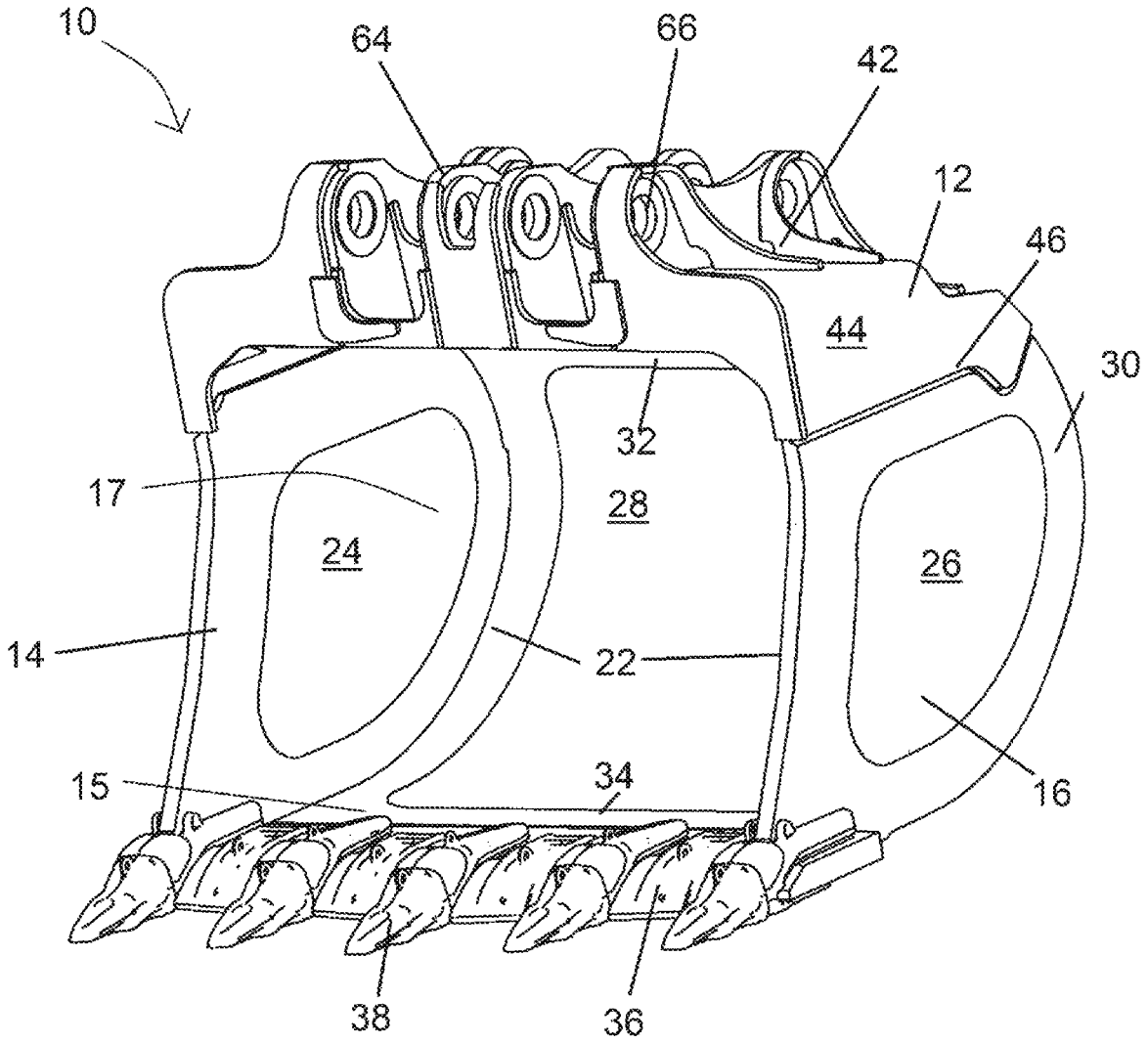
FIG. 1 is an upper front perspective view of a bucket having a load section and a handling section positioned above the load section.
Figure 2:
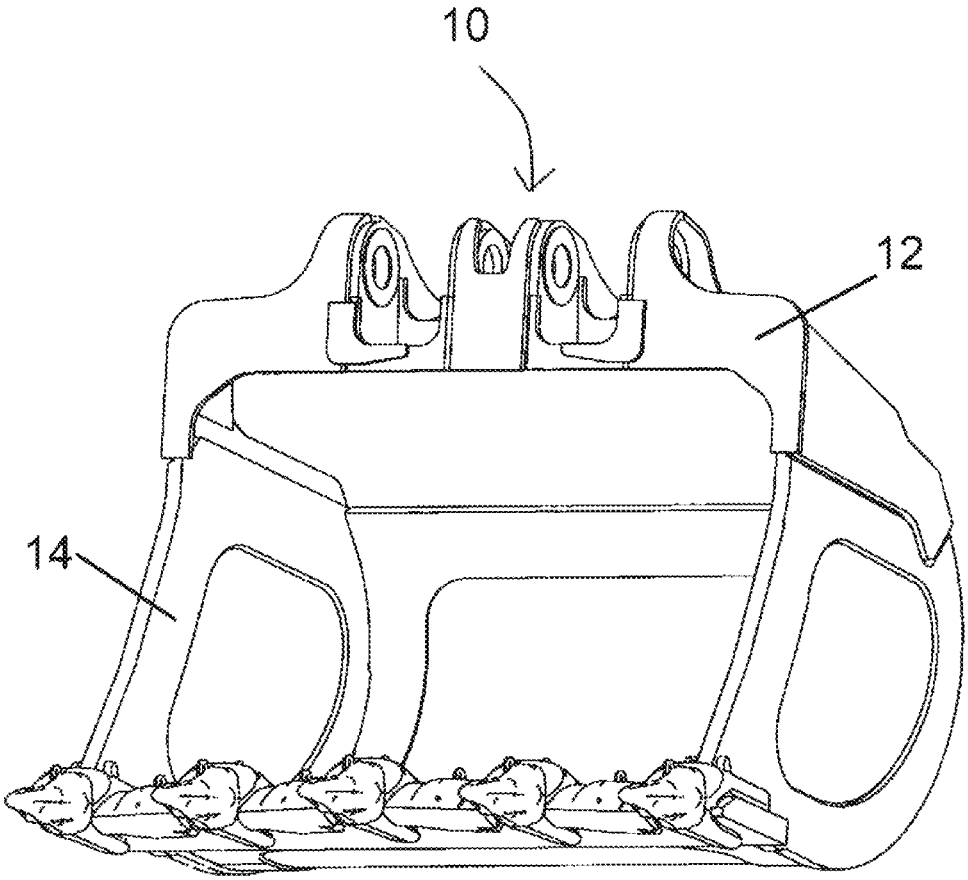
FIG. 2 is a lower front perspective view of the bucket of FIG. 1.
Figure 3:
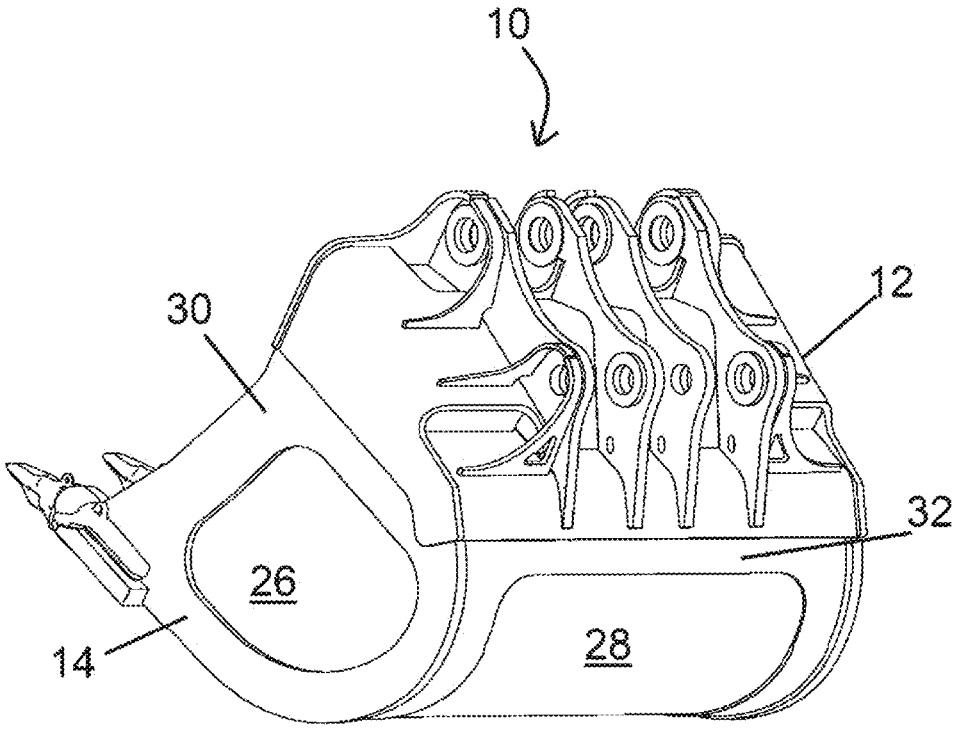
FIG. 3 is an upper rear perspective view of the bucket of FIG. 1.
Figure 4:
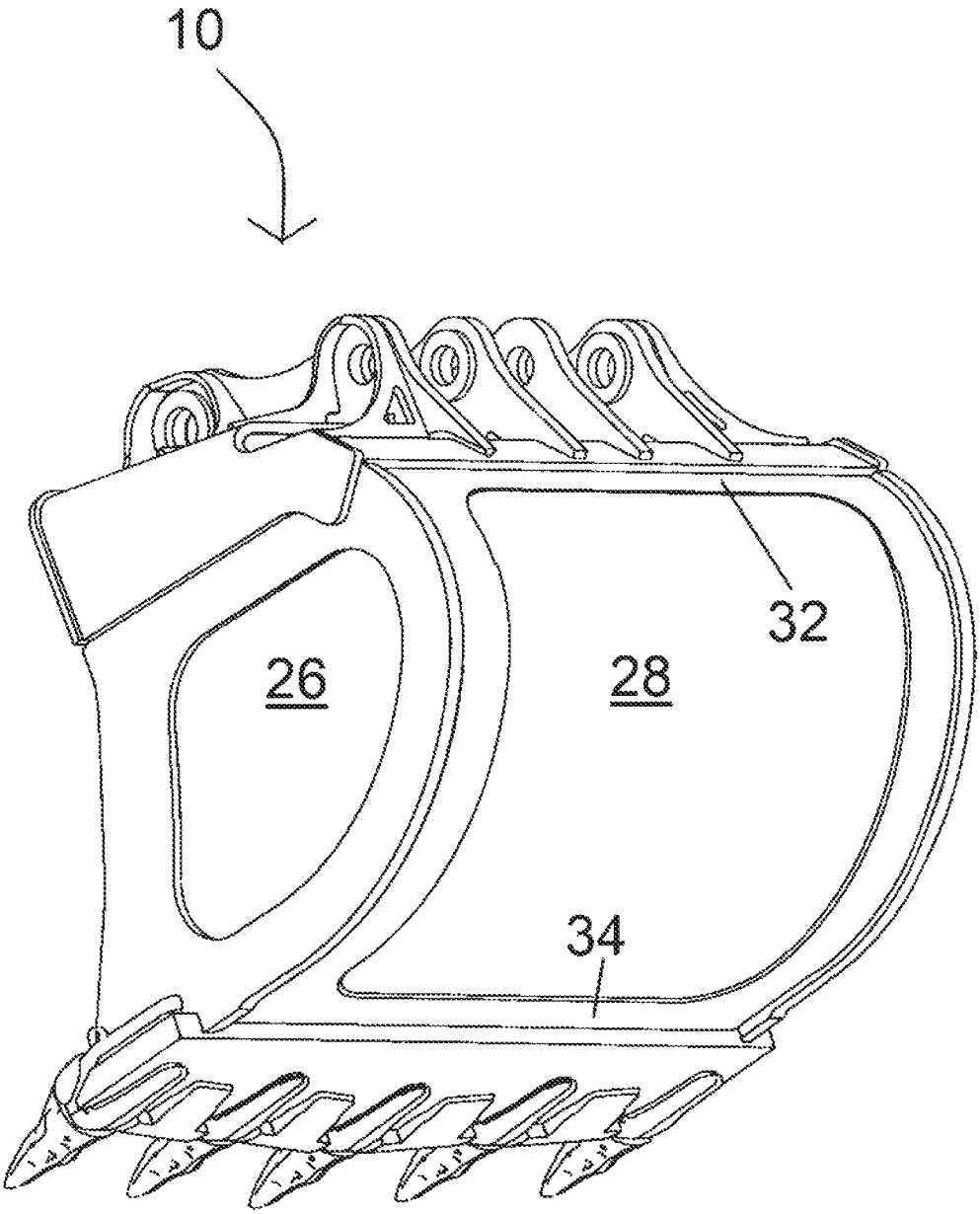
FIG. 4 is a lower rear perspective view of the bucket of FIG. 1.
Figure 5:
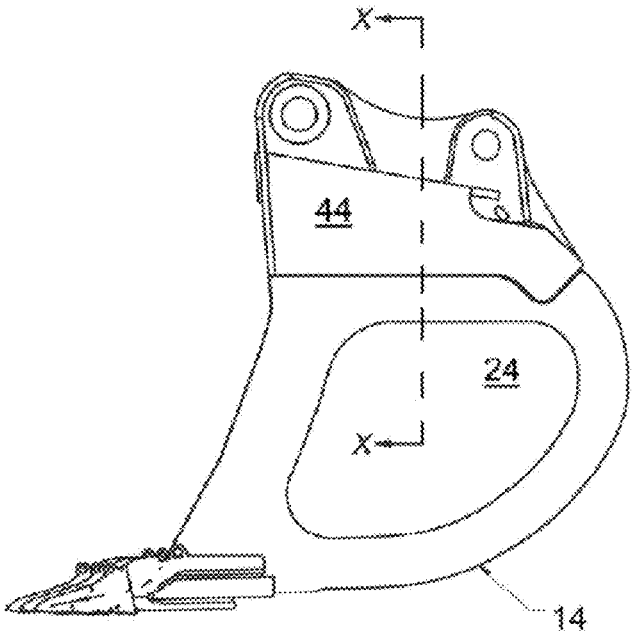
FIG. 5 is a side view of the bucket of FIG. 1.
Figure 6:
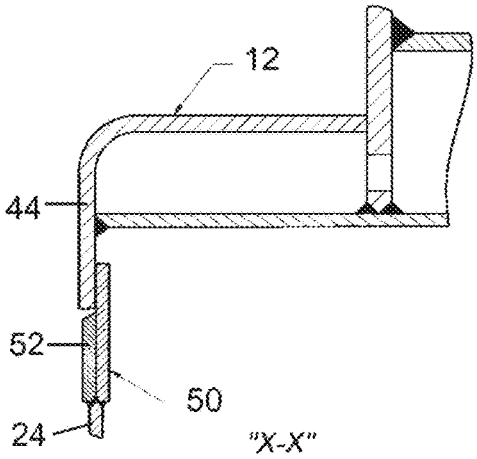
FIG. 6 is a section view showing sectional details of part of the bucket shown in FIG. 5.
Figure 7:
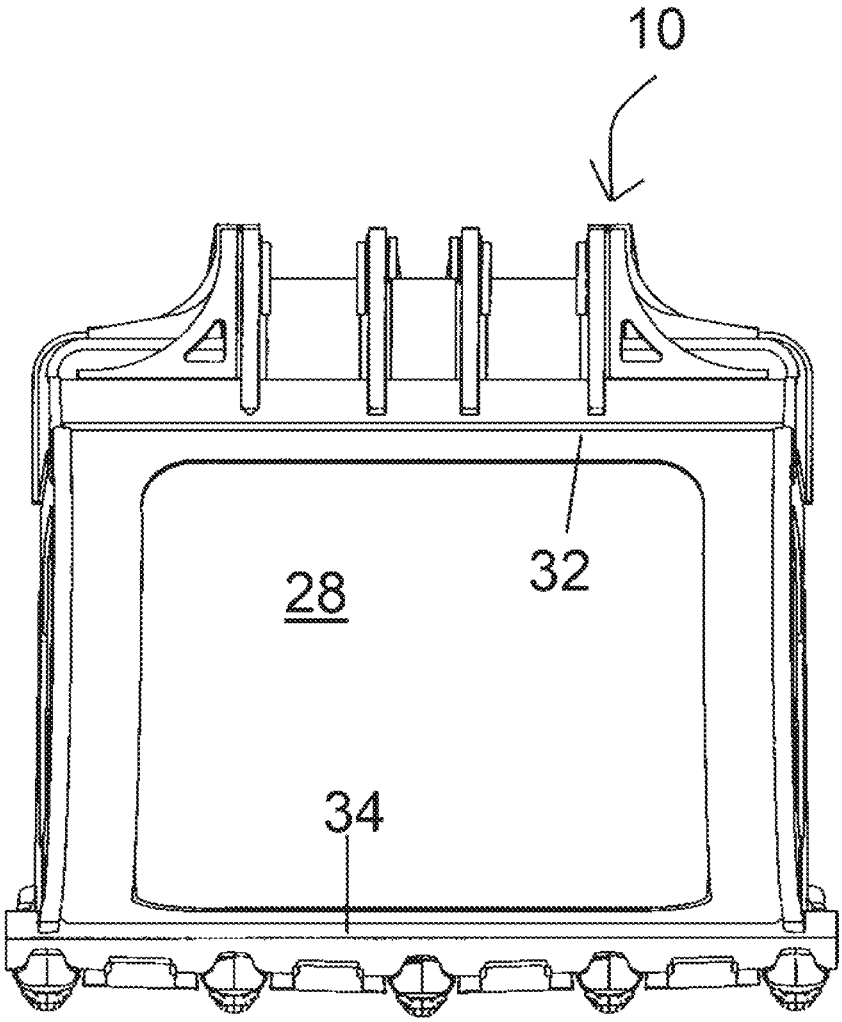
FIG. 7 is a rear view of the bucket of FIG. 1.

In FIGS. 1 to 14, reference numeral 10 refers generally to an excavation bucket suitable for use in excavation.

The bucket 10 comprises a handling section 12 and a load section 14 that is mounted on the handling section 12 such that it is separable, i.e. can be separated, from the handling section 12. This enables the load section 14 to be separated from the handling section 12 and replaced with another load section. In the embodiment illustrated in FIGS. 1 to 13, the load section 14 is mounted on the handling section 12 by the act of welding the load section 14 to the handling section 12. Thus, it can be separated from the handling section 12 by any one of the available technologies for cutting through a weld connection including oxy torches, air arc gouging or grinding.

The load section 14 has a substantially box-like configuration with a base 15 and a wall 16 extending up from the base along three sides. A fourth side is open and defines a mouth 17 for receiving excavated material. Further, the load section 14 has an open top 19 (se FIGS. 9 and 10).

Structurally the load section 14 is formed by a frame 22 and a plurality of plates mounted on the frame 22. More specifically, the frame 22 defines side panels on each side of the frame 22 and side plates 24, 26 that extend across the side panels. Further, the frame 22 defines at least one support panel extending across the rear of the load section between the side panels and a support plate 28 mounted on the frame 22 extending across the support panel.

Figure 8:
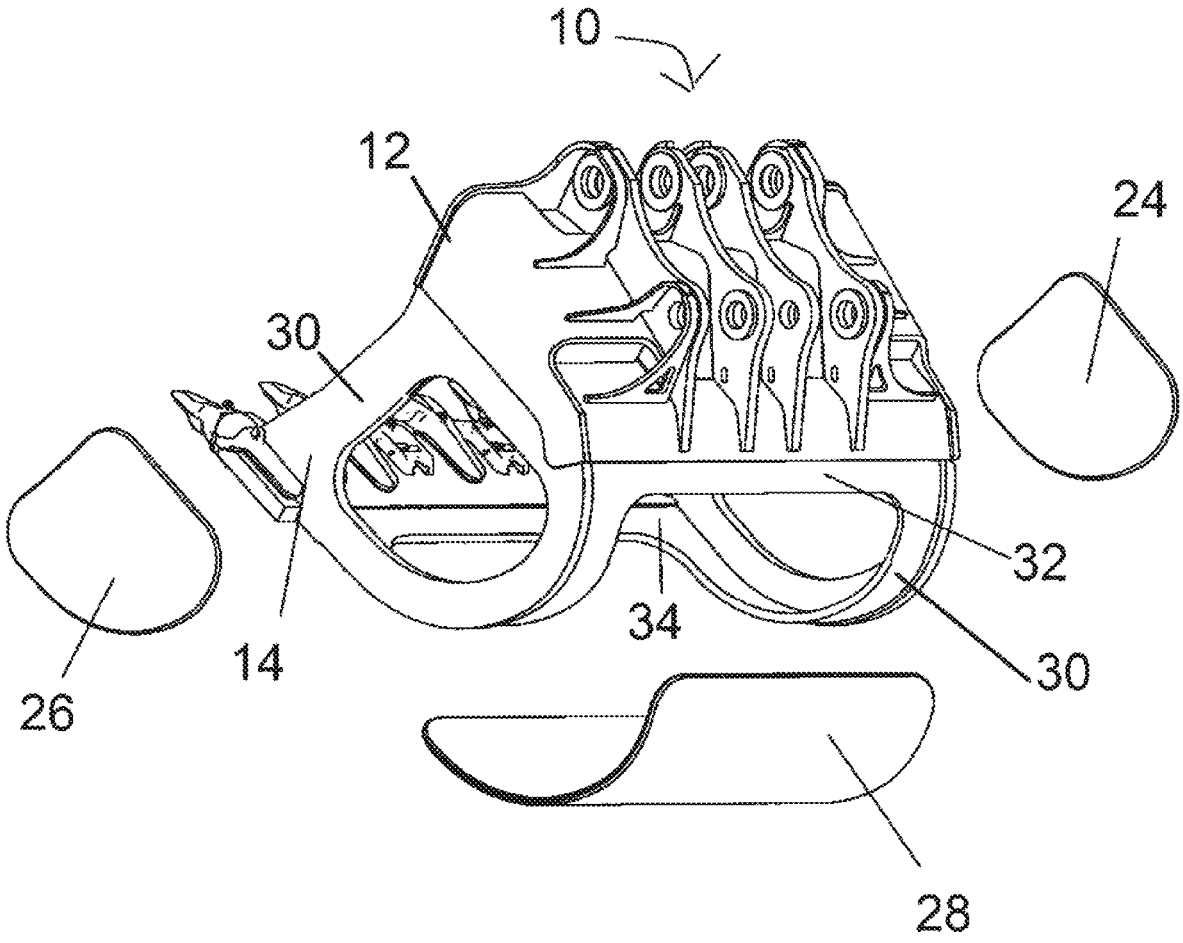
FIG. 8 is an exploded rear view perspective of the bucket of FIG. 1 showing the plates separated from the load section.

FIG. 8 shows an exploded view of the bucket 10 with the plates 24, 26, 28 separated.

The frame 22 in turn comprises two side frame members 30 being one on each side of the bucket 10. The frame 22 also includes two transverse frame members an upper 32 and a lower 34 extending across the rear of the load section 14 between the side frame members 30.

The wall 16 of the load section 14 has an upper edge 18 forming a mounting formation that is peripheral edge formation 20 that is further to and interacts with a peripheral edge formation on the handling section 12 in a way that will be described in more detail below.

The upper edge 18 of the wall 16 is defined by the upper edge of the side wall frame members 30 and the upper edge of the upper transverse frame element 32.

The plates 24, 26, 28 are welded to the frame 22 and are able to be removed when they become worn or damaged.

The bucket 10 further includes a scraper 36 mounted on the frame 22 adjacent the mouth 17. As shown in the drawings, the scraper 36 has ground engaging teeth 38 for assisting the bucket 10 to excavate ground.

The handling section 12 comprises a mounting plate 42 having a skirt 44 around its peripheral edge. The skirt 44 extends away from the mounting plate 42 and forms a mounting formation in the form of a peripheral edge formation 46 that interacts with the complementary further peripheral edge formation 20 on the load section 14.

Figure 9:
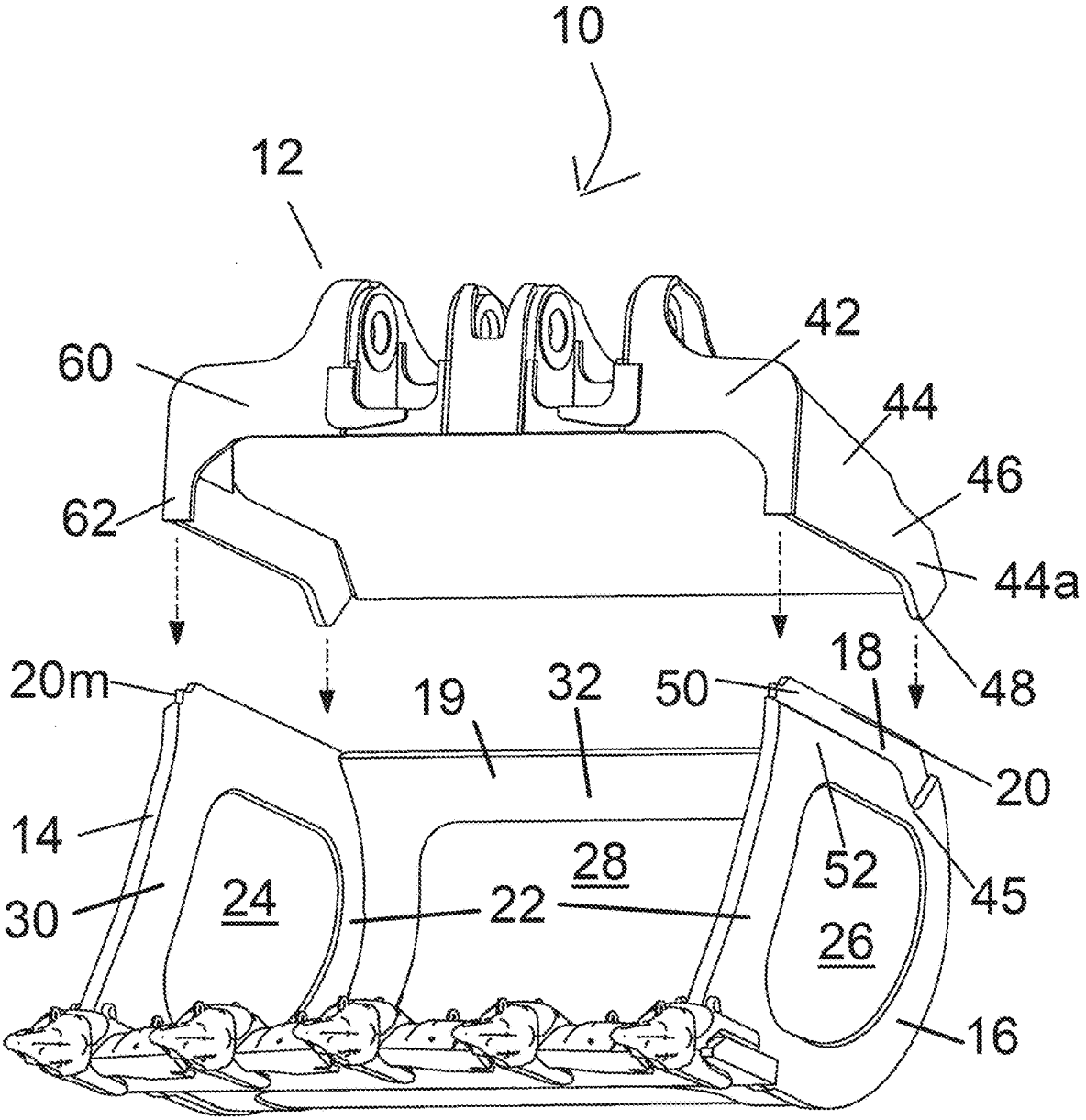
FIG. 9 is an exploded front perspective view of the bucket of FIG. 1 showing the handling section separated from and above the load section.
Figure 10:
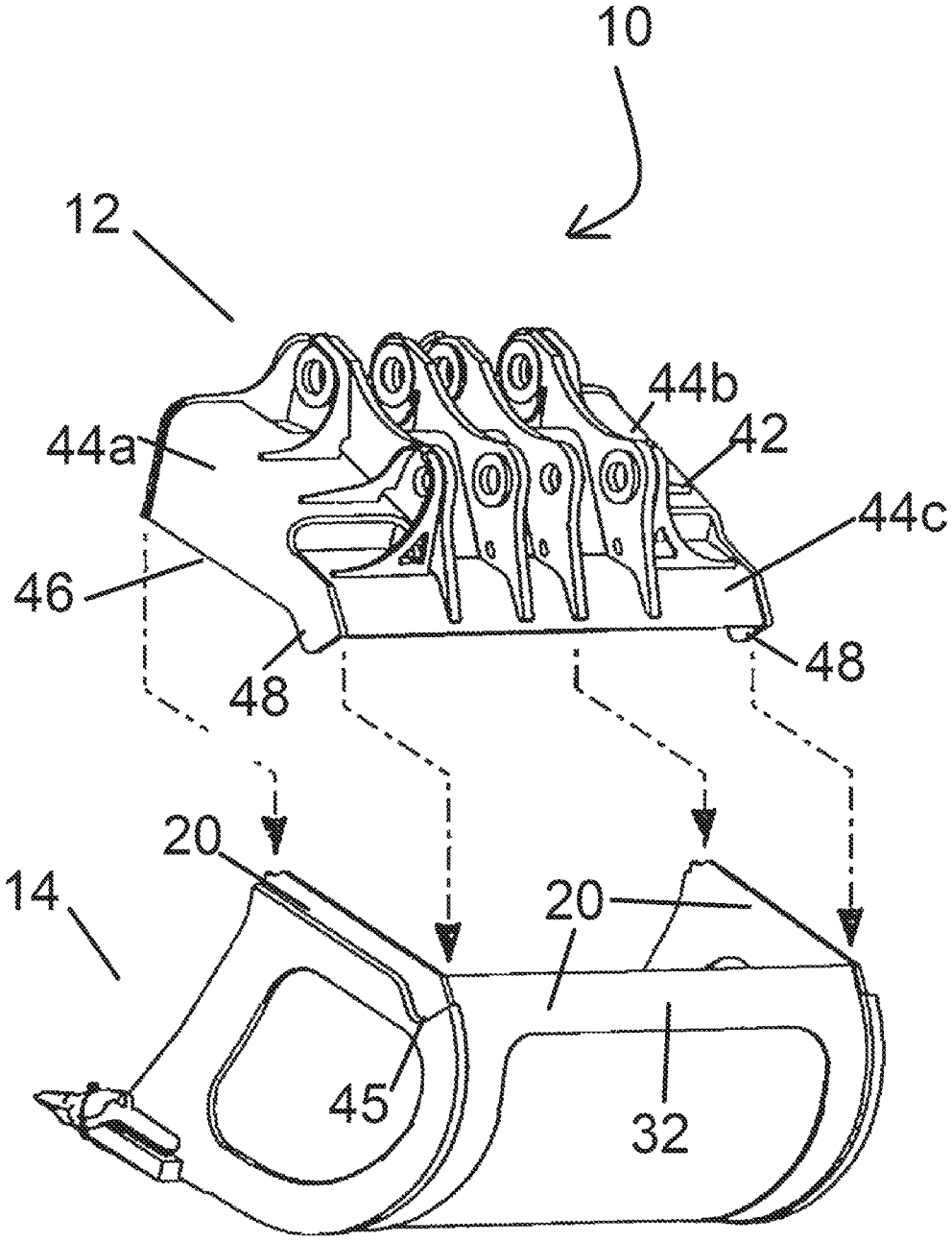
FIG. 10 is an exploded rear perspective view of the bucket of FIG. 1 showing the handling section separated from and above the load section.
Figure 11:
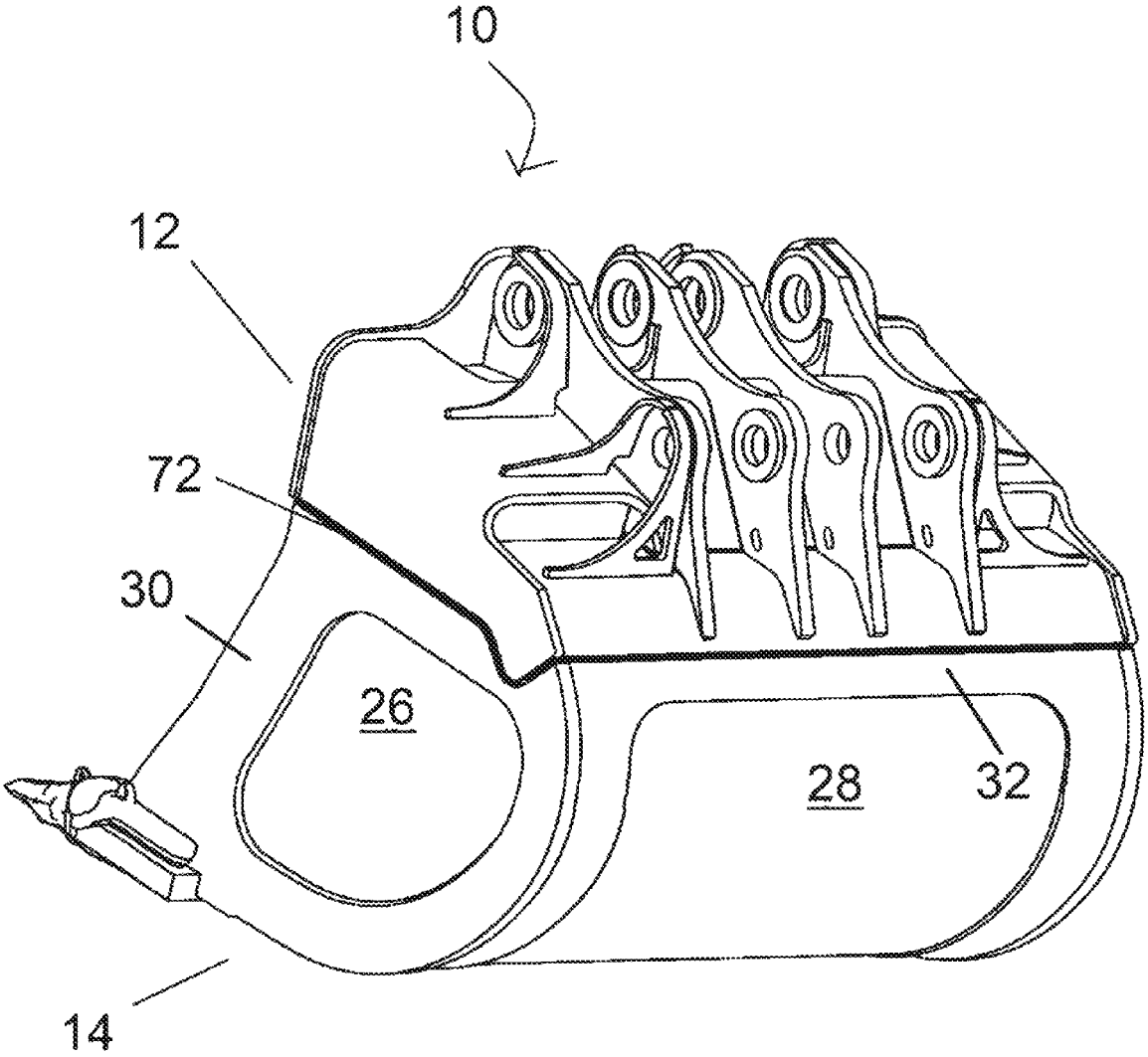
FIG. 11 is a schematic rear-perspective view showing how the load section is welded to the handling section of the bucket of FIG. 1.
Figure 12:
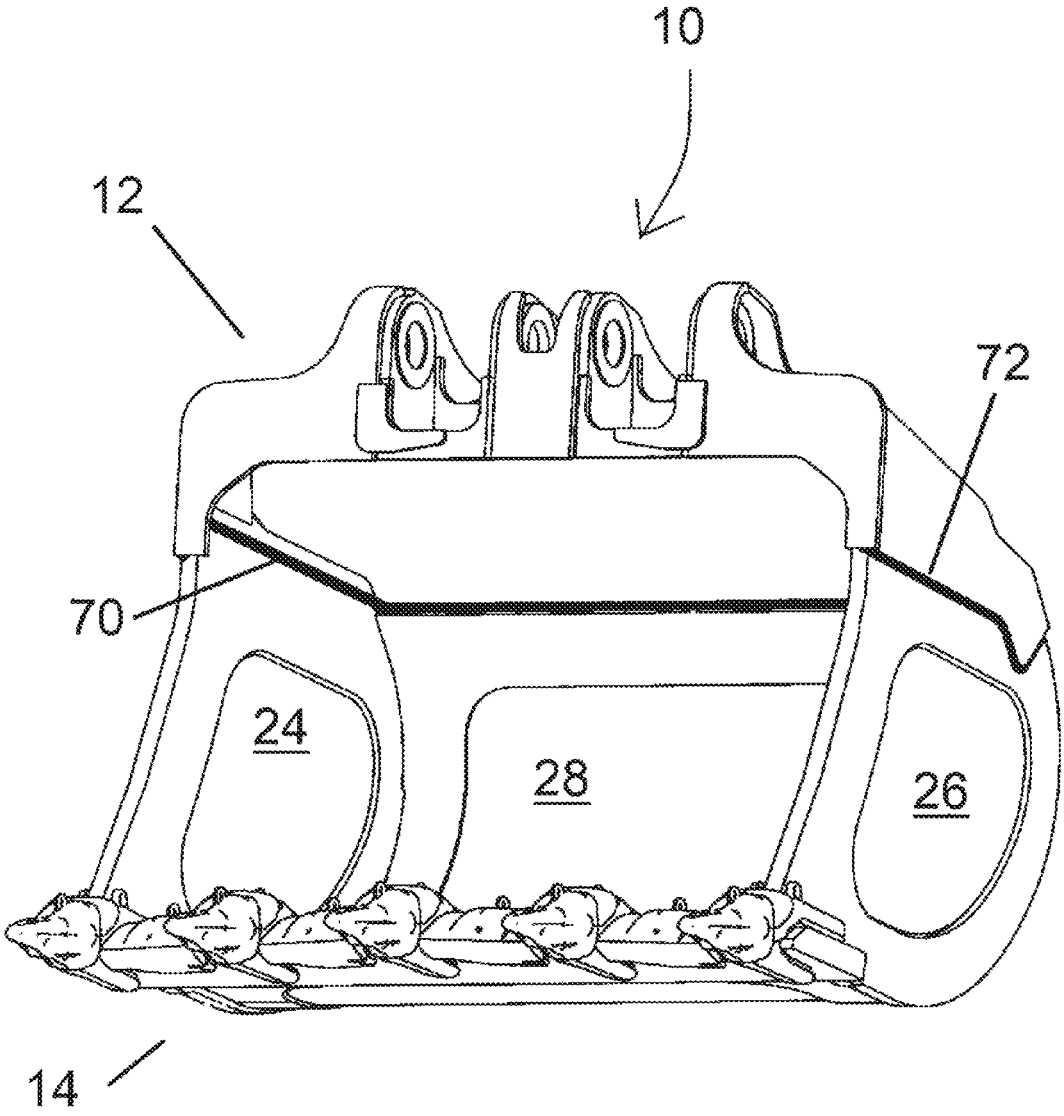
FIG. 12 is a schematic front-perspective view showing how the load section is welded to the handling section of the bucket of FIG. 1.
Figure 13:
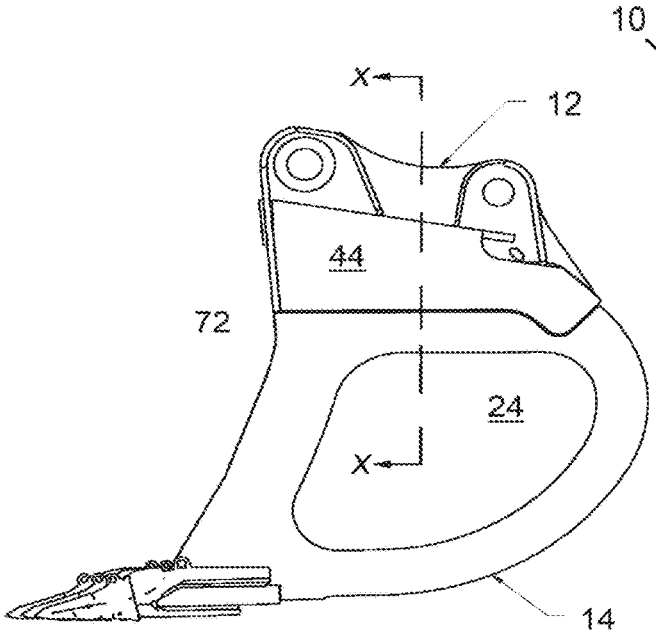
FIG. 13 is a side view of the bucket of FIG. 11.

With reference to FIGS. 9 and 10, the upper side frame elements 30 are in two parts, an inner element part 50 and an outer element part 52 that are welded together. The inner parts 50 define side parts of a peripheral edge formation 20 of the load section 14. The upper part of upper frame member 32 defines a rear part of the peripheral edge formation 20 (more clearly seen in FIG. 10).

The mounting plate 42 is substantially rectangular having four sides and the skirt 44 is configured to extend circumferentially around the further peripheral edge formation 20 of the load section 14. Thus, at least part of the skirt 44 overlaps with the complementary peripheral edge formation 20 to provide a surface for securing the two sections 12, 14 to each other.

The skirt 44 has two sides 44*a*, 44*b* and a rear section 40*c*. Each side 44*a*, 44*b* has a depending key part 48. The outer side element part 52 of the load section 14 has a complementary recess 45. When the two parts are joined, the key part 48 locates within recess 45 to allow simple and accurate joining of the handling section 12 and the load section 14. The leading edge of recess 45 may also provide a bearing surface when the bucket 10 is digging backwards towards the excavator.

The mouth end 20*m* of the peripheral edge formation 20 has a stepped profile as shown in FIGS. 9 and 10. The handling section 14 has a front panel 60 having a tab 62 on either side that is received by the stepped portion. Again, this assists in locating the two parts together. This is shown in the cross section shown in FIG. 6.

It will be appreciated that when the two sections 12, 14 are joined, the inner surface of the skirt abuts the outer surface of the peripheral edge formation 20. This abutment may be clearly seen in the cross section of FIG. 6.

The handling section 14 further includes a mounting arrangement comprising a plurality of ear plates 64 on the mounting plate 42 spaced apart from each other for interacting with a bucket handling arrangement on an excavator. Each ear plate 64 defines an opening 66 for receiving a pivot pin from the bucket handling arrangement for enabling the bucket 10 to be pivoted relative to the bucket handling arrangement. As the structure and function of the bucket handling arrangement for manoeuvring and handling a bucket would be well known in the art and does not form part of the disclosure, it will not be described in further detail. The machining of the ears 64 is required to be carried out to a high tolerance and is thus expensive.

Figure 14:
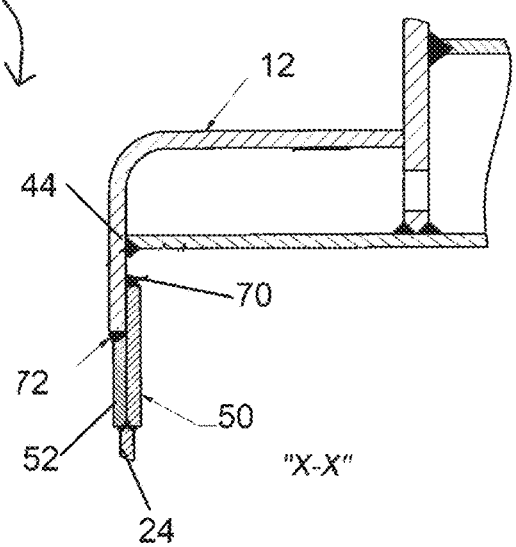
FIG. 14 is a section view showing sectional details of part of the bucket shown in FIG. 11.

FIGS. 11 to 14 show how the handling section and load section are welded together. The parts are welded together along an internal 70 and external 72 weld line. FIG. 14 shows the cross section with the abutting surfaces welded together. It will be appreciated that the dual weld lines provide for a very strong connection between the two sections.

Figure 15:
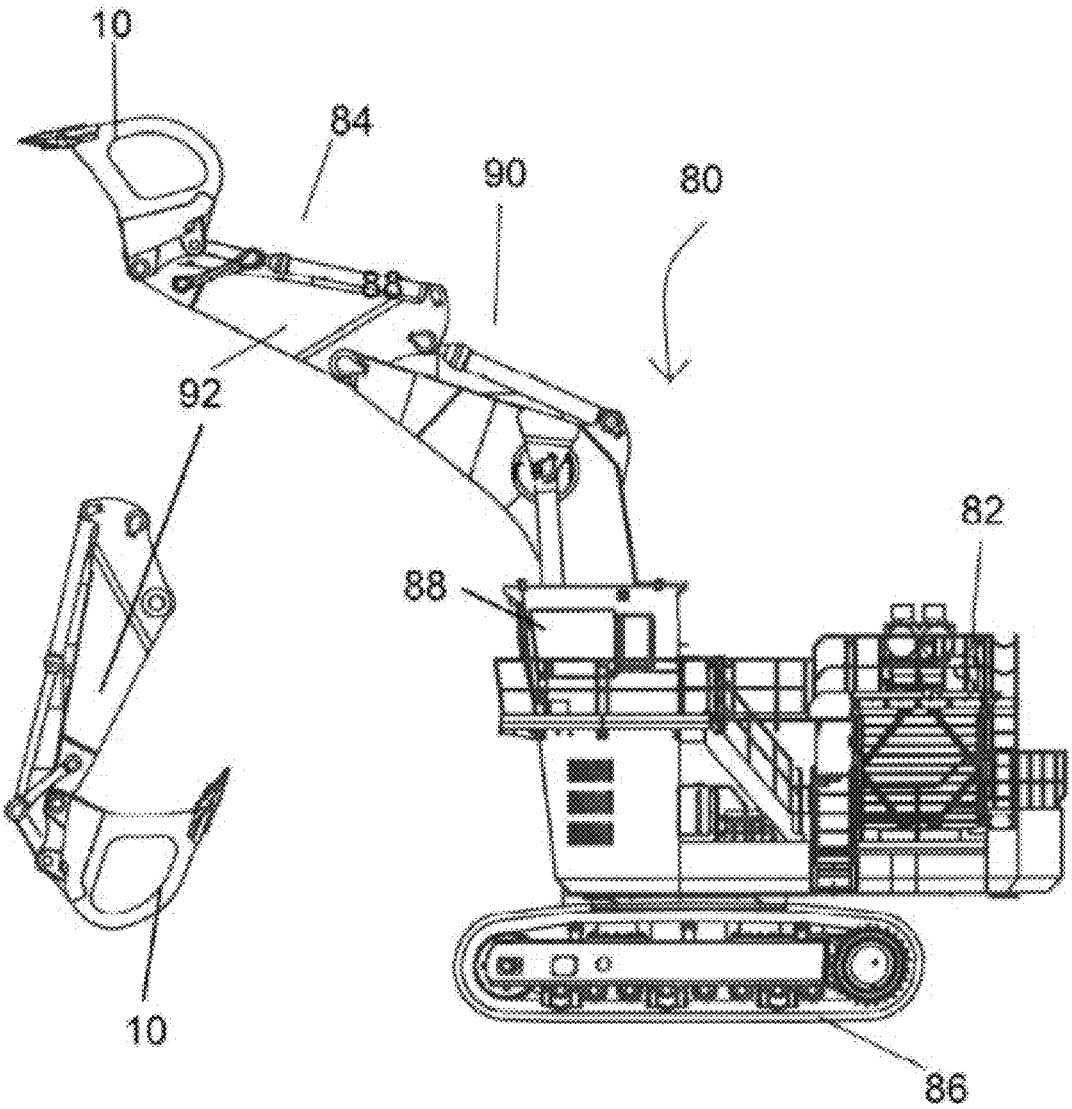
FIG. 15 is a side view of an excavator having a boom and a bucket like those illustrated in the preceding drawings mounted at the end of the boom.
Figure 16:
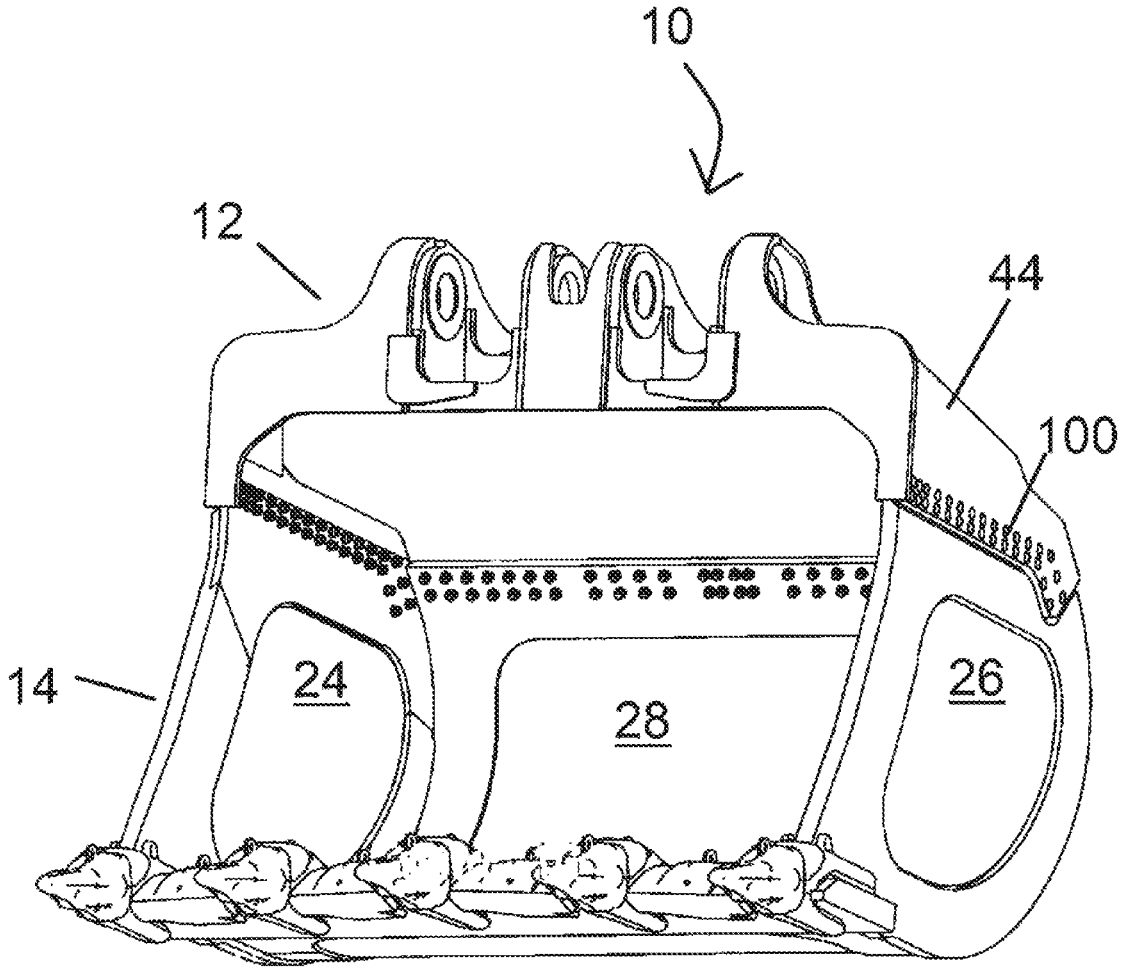
FIG. 16 is a front-perspective view of a bucket that is a variation on the bucket of FIG. 1.
Figure 17:
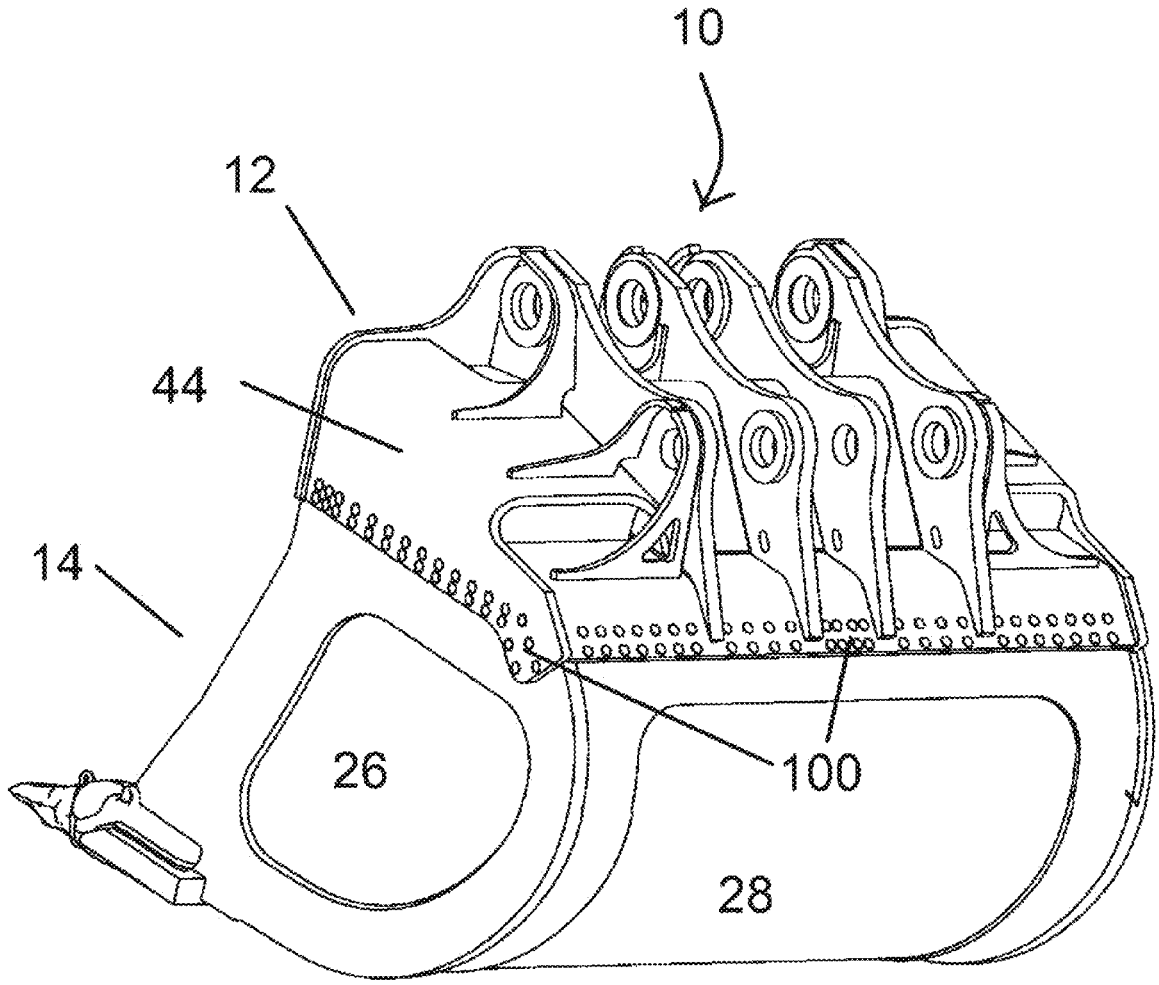
FIG. 17 is a rear-perspective view of the bucket of FIG. 16.
Figure 18:
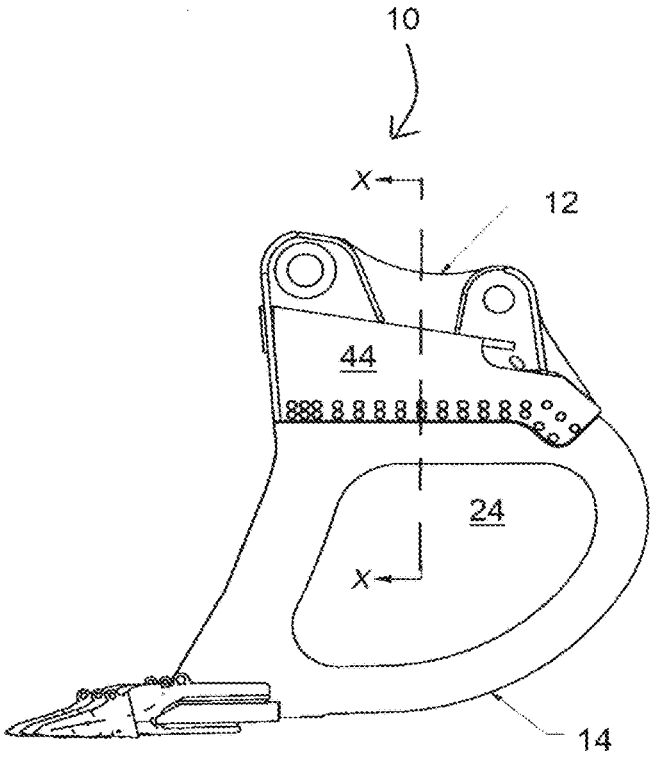
FIG. 18 is a side view of the bucket of FIG. 16.

FIG. 15 illustrates an example excavator that is used with an excavator bucket in accordance with FIGS. 1 to 14 above.

The excavator 80 comprises a support 82 and an articulating member 84 extending from the support. The support 82 is a movable support having ground engaging formations 86 and including an operator cab 88. The articulating member 84 comprises a boom 90 extending from the support 82 and a dipper 92 at a remote end of the boom 90 that articulates relative to the boom 90. A bucket 10, like that described above with reference to FIGS. 1 to 14, is detachably mounted on an end of the articulating member 84 remote from the support 82.

In use, the bucket 10 is typically used on an excavator 80 like that illustrated in FIG. 15 to excavate and remove material from the ground.

When the bucket 10 is operational and being used for work, the handling and load sections 12 and 14 are fixed to each other and operate as a single unit. The load section 14 is exposed to significantly greater forces than the handling section 12 during typical operation of the bucket, e.g. due to rocks and other ground material. As such it is prone to wear and to damage over time. It would thus be expected to have a shorter working life time than the load section 14 which does not bear the brunt of collisions with material being excavated.

When the load section 14 becomes damaged or worn out or otherwise requires replacement, operation of the excavator can be interrupted and the bucket removed and taken to a workshop.

The lower load section 14 can then be replaced with a new undamaged and unworn lower section 14 which is secured to the original handling section 12 and which is thus reused. To do this, the original load section 14 is separated from the upper handling section 12 which involves cutting through the weld connection that attaches and secures the load and handling sections 14 and 12 to each other. This is carried out using cutting torches or other tools that are known in the art. As these techniques would be well known to persons skilled in the art and do not form part of the invention claimed in this application, they will not be described in further detail in this specification. A new unworn load section 14 is then mounted on the original or same handling section 12, e.g. by welding the section 14 to the section 12.

The new load section 14 is mounted on the section 12 by receiving the skirt of the mounting section forming the peripheral edge formation described above. The skirt 44 forming the peripheral edge formation 46 on the section 12 is positioned so that it circumferentially surrounds the complementary formation 20 on the load section 14 such that the surfaces of the two formations 20 and 46 are in abutment. The two sections 12 and 14 are then welded to each other and the bucket 10 is ready to be re-attached to the excavator 80 and be re-used. More specifically the peripheral and further peripheral edge formations 20 and 46 are welded to each other along their lengths on both an inside and outside of the bucket. The complementary abutting surfaces are shown particularly clearly in FIGS. 1 and 3. During use, when being driven into ground or being dragged through ground, the bucket is subjected to high forces, particularly high shear forces. This provides an attachment with sufficient engineering strength to carry out its function.

A variation on the bucket 10 shown in FIGS. 1 to 14 is shown in FIGS. 16 to 19. This bucket is similar to the bucket described above with reference to FIGS. 1 to 11 and thus unless otherwise indicated, the same reference numerals will be used to refer to the same components. Accordingly, the following description will focus on the differences between this embodiment and the earlier embodiment.

In this bucket, the mounting section is attached to the load carrying section by means of fastening elements that are bolts that pass through the mounting and load carrying sections and attach them together.

Figure 19:
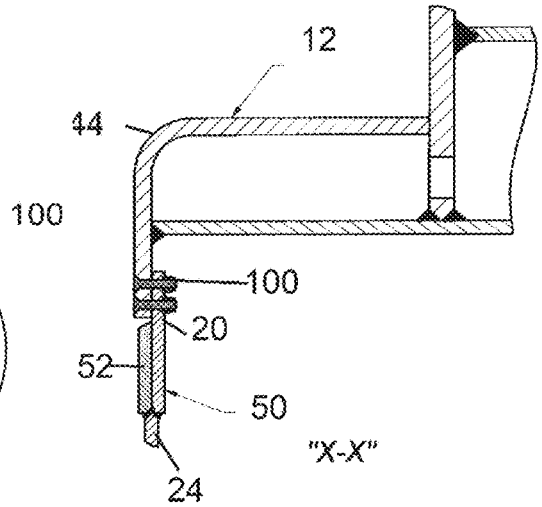
FIG. 19 is a section view showing sectional details of part of the bucket shown in FIG. 16.

In this bucket 10, the handling section 12 is attached to the load carrying section 14 by means of fastening elements 100 that are rivets that pass through the handling 12 and load carrying sections 14 and attach them together. The cross section in FIG. 19 shows the rivets 100 passing through the skirt 44 and the peripheral edge formation 20 so as to join the two sections together.

An advantage of the bucket described above with reference to the drawings is that enables a load carrying section to be separated from an attached bucket mounting section and be placed with another new load carrying section. This can be carried out with a minimum of downtime.

Different buckets have different designs particularly as regards their load carrying sections for carrying out different functions in different applications. For example, different designs of load carrying sections are used for excavating soft soil as compared to excavating rocky earth.

Another advantage is that a certain load carrying section can be separated from the bucket mounting section to which it is attached and be replaced with a different load carrying section of different design.

Another advantage is that the load carrying section can be built with a lighter structure knowing that it does not need to sustain the same working life time as the bucket handling section. This helps to avoid the use of bucket liners which are time consuming and expensive to replace.

Another advantage of avoiding the use of bucket wear liners is that they can store energy and cause a safety hazard when the liners are being removed.

The handling section can be designed for an extended and predetermined life. Suitably, the handling section may maintain structural integrity for a service life of up to about 3000 hours or four to five years.

The complementary abutting surfaces of the respective mounting formations provides an attachment with sufficient engineering strength to withstand the forces experienced in use.

A still further advantage is that the handling section is in the form of a top plate and the walls of the bucket are provided by the load section. This allows the use of the removable side plates.

It will of course be realized that the above has been given only by way of illustrative example of the invention and that all such modifications and variations thereto, as would be apparent to persons skilled in the art, are deemed to fall within the broad scope and ambit of the invention as is herein set forth.

The invention claimed is:

1. A bucket for moving ground material, the bucket comprising:

a handling section that is separably coupled to a separate load section, the handling section and the load section forming a fixed mouth through which ground material is received into the load section and through which ground material is discharged, wherein:

the load section comprises a base, a wall extending up from the base, and an open side that defines the mouth;

the handling section comprises a mounting arrangement configured for coupling to a hydraulic bucket handling arrangement for pivoting the bucket between a loading position and a discharge position;

the handling section includes a mounting formation and the load section includes a further mounting formation that is complementary to said mounting formation, and the load and handling sections are connected together so that the load section is separable from the handling section and can be separated and replaced with another load section; and the handling section comprises a mounting plate and a skirt extending away from the mounting plate, and the mounting formation comprises the skirt, and the mounting formation is configured to receive the further mounting formation therein with a surface of the mounting formation and a surface of the further mounting formation in abutment.

2. The bucket according to claim 1, wherein the mounting formation or the further mounting formation includes at least one alignment part, and the other of the further mounting formation or mounting formation, includes at least one further alignment part complementary to said at least one alignment part.

3. The bucket according to claim 1, wherein the mounting formation or the complementary mounting formation includes at least one key section, and the other of the complementary mounting formation or mounting formation includes a recess complementary to the key section.

4. The bucket according to claim 3, wherein the wall has an upper edge and the further mounting formation that engages the mounting formation on the handling section comprises the upper edge.

5. The bucket according to claim 1, wherein the load section is mounted on the handling section by welding and is separable from the handling section by breaking the weld, or the load section is mounted on the handling section by fastening elements and is separable from the handling section by removing the fastening elements.

6. The bucket according to claim 1, wherein the mounting arrangement on the handling section includes a plurality of ear plates projecting up from the mounting plate and spaced apart from each other, each ear plate forming an opening for receiving a pivot pin there through whereby to permit the bucket to be pivoted by a bucket handling arrangement.

7. The bucket according to claim 1, wherein the load section comprises a frame and a plurality of plates mounted on the frame and at least one plates is separable from the frame so that the plate can be separated and replaced with another plate.

8. The bucket according to claim 7, wherein the at least one of the plates is separably mounted on the frame by welding and is separated from the frame by breaking the weld.

9. The bucket according to claim 7, wherein the frame has two sides and the load section includes a side plate mounted on each side of the frame.

10. The bucket according to claim 9, wherein the frame defines at least one support panel extending between the sides, and the load section includes at least one support plate mounted on the frame and extending across the support panel.

11. The bucket according to claim 10, wherein the at least one support plate is separable from the frame so that the support plate can be separated and replaced with another support plate.

12. The bucket according to claim 7, wherein the bucket further includes a scraper mounted on the frame adjacent the mouth, and a plurality of replaceable ground engaging formations removably mounted on the scraper and on the frame adjacent the mouth.

13. The bucket according claim 1, wherein the bucket is an excavating bucket.

14. A ground moving machine comprising:

a support;

an articulating member extending from the support and the bucket according to claim 1 mounted on the end of the articulating member.

15. A method of servicing or repairing the bucket according to claim 1, the method including:

separating the load section from the handling section; and attaching another load section to the handling section.

16. The method according to claim 15, wherein the load section and the handling section are welded to each other and separating the load section from the handling section comprises breaking the weld mounting them to each other, and attaching another load section to the handling section comprises welding the load and handling sections to each other.

17. A method of servicing or repairing the bucket according to claim 7, the method including:

detecting when one of the separable plates needs replacement;

separating the plate from the frame; and attaching another plate to the frame.

18. An excavator for excavating ground material from the ground, comprising:

a support;

an articulating member extending from the support; and a bucket comprising a handling section that is connected to a separate load section and a mouth through which ground material is received into the load section and through which ground material is discharged, wherein:

the load section comprises a base, a wall extending up from the base and an open side that defines the mouth;

the handling section comprises a mounting arrangement configured for coupling to a hydraulic bucket handling arrangement for pivoting the bucket between a loading position and a discharge position; and the handling section includes a mounting formation, and the load section includes a further mounting formation that is complementary to said mounting formation and wherein the load section and the handling sections are connected together such that the load section is separable from the handling section so that the load section can be separated and replaced with another load section.

19. An excavator according to claim 18, wherein the support is a movable support having ground engaging formations and the support member may include an operator cab.

20. An excavator according to claim 18, wherein the articulating member comprises a boom extending from the body and a dipper at a remote end of the boom that articulates relative to the boom.

21. An excavator according to claim 20, wherein the load section is mounted on the bucket mounting section by welding the load section to the handling section and is separated from the handling section by breaking the weld.

* * * * *